US005624271A

United States Patent [19]

Childs et al.

[11] Patent Number: 5,624,271

[45] Date of Patent: Apr. 29, 1997

[54] CONNECTOR LATCH INTERLOCK PLATE

[75] Inventors: Christopher J. Childs, Rochester Hills; Brian M. Hood, Clinton Township, both of Mich.

[73] Assignee: United Technologies Automotive, Inc., Dearborn, Mich.

[21] Appl. No.: 329,293

[22] Filed: Oct. 26, 1994

[51] Int. Cl.[6] ..... H01R 13/627

[52] U.S. Cl. ..... 439/352; 439/357

[58] Field of Search ..... 439/350, 351, 439/352, 353, 354, 355–358, 345, 347

[56] References Cited

U.S. PATENT DOCUMENTS

| | | | |
|---|---|---|---|
| 4,634,204 | 1/1987 | Detter et al. | 439/352 |
| 4,946,404 | 8/1990 | Tabenouchi et al. | 439/352 |
| 5,292,258 | 3/1994 | Sakurai | 439/352 |
| 5,370,550 | 12/1994 | Alwine et al. | 439/352 |

*Primary Examiner*—Hien Vu
*Attorney, Agent, or Firm*—Howard & Howard

[57] ABSTRACT

An interlock plate is received on an electrical connector which includes a latch to be received in a channel on a mating electrical connector. The plate is selectively movable between locked and unlocked positions, and prevents movement of the latch outwardly of the channel when in the locked position. The electrical connection is made by connecting the two electrical connectors, with the latch moving into the channel. During this initial connection, the plate is received on the electrical connector in the unlocked position. The plate is then moved to the locked position, where it remains while the electrical connection is maintained. At that position, abutments on the plate and the connector prevent movement of the latch outwardly of the channel. Should it be desired to disconnect the electrical connection, the plate is initially moved back to its unlocked position, and the connectors may then be separated. The plate is configured such that it will force the latch into the channel when moved to the locked position should the latch not be fully received within the channel. In addition, the plate prevents connection of the first and second electrical connectors when in the locked position. Finally, structure on the electrical connector and plate insures that the plate is securely retained on the electrical connector during assembly and shipment.

14 Claims, 2 Drawing Sheets

CONNECTOR LATCH INTERLOCK PLATE

BACKGROUND OF THE INVENTION

This invention relates to an interlock plate which prevents the latch of an electrical connector from moving out of its mating channel while the electrical connection is made.

Electrical connections in modern vehicle environments are typically made with plug-in connections to facilitate speed and accuracy of the connections. While such connections have gained wide success, some problems do exist in that the connections have sometimes become disconnected. To that end, the prior art has included various features which attempt to prevent disconnection of the connectors.

In one prior art example, an electrical connection is often made by providing one of the two electrical connector with a latch that extends upwardly into a channel in the other of the electrical connectors. The latch is biased into the channel when the two connectors are snapped together, and the electrical connection between the two connectors is made at a location remote from the latch and channel. The latch and channel connection maintains the connectors fully connected. Some problems exist with this type of electrical connection, since the latch is typically biased into the channel by a relatively small force. Thus, should something come into contact with the latch, it may easily move outwardly of the channel, allowing the electrical connection to become unconnected. The small bias force is desirable to facilitate assembly, but possible disconnection is an undesirable result. In fact, disconnection of latch-type electrical connectors due to movement of the latch outwardly of the channel is one of the greatest complaints with latch-type electrical connections.

To address the problem of latch movement, the prior art has attempted to place various devices onto the connectors to hold the latch in the locked position. These devices have not been fully successful, as they have sometimes complicated the connection of the electrical connectors, or unduly increased the required insertion force.

One other major problem in the prior art is the partial connection of the electrical connectors, with the latch only partially received in the channel, and consequently only partial electrical connections between the electrical connectors. The prior art has also not successfully addressed this problem.

SUMMARY OF INVENTION

In a disclosed embodiment of this invention, an interlock plate is received on the latch of an electrical connector. The interlock plate is movable relative to the latch between locked and unlocked positions. When the interlock plate is in the locked position, it prevents movement of the latch downwardly out of the channel. Once the electrical connection is made, and the latch is received in the channel, the interlock plate is moved to the locked position. The latch can no longer be accidentally moved outwardly of the channel. Rather, the interlock plate must be moved back to the unlocked position before the latch will be able to be moved outwardly of the channel for disconnection. Further, movement of the interlock plate to the locked position forces the latch into the channel, avoiding partial connection of the connectors.

In a preferred embodiment of this invention, the interlock plate is separate from the remainder of the latch, and slides along a tongue on the electrical connector which includes the latch. The interlock plate includes a guide channel slidable on the tongue between the unlocked and locked positions. In further features of this invention, the tongue which carries the latch includes two stops, and the interlock plate includes an arm with an ear that is positioned between the two stops in the unlocked position. The interlock plate is moved beyond the stops when in the locked position.

An abutment on an underside of the interlock plate is aligned with a mating abutment on a first connector when the interlock plate is in the locked position. The aligned abutments prevent the interlock plate, the tongue, and hence the latch, from being moved downwardly while the interlock plate is in the locked position. The same aligned abutments force the latch of a partially connected connector into the channel, assuring complete connection.

In the unlocked position, the abutment on the interlock plate is spaced from the abutment on the connector. The interlock plate and tongue may then move downwardly such that the latch may move outwardly of the channel. At the same time, since the ear on the interlock plate is received between the two stops on the tongue, the interlock plate is securely retained on the tongue such that it is not lost during assembly or shipment. In other features of this invention, the ears, abutments and stops have appropriately ramped surfaces to facilitate the movement of the ear and the remainder of the interlock plate between the locked and unlocked positions.

In a method according to the present invention, a first connector element is initially assembled by placing the interlock plate on a tongue associated with the first connector, and which also carries the latch. The interlock plate is initially placed in an unlocked position with the ear received between two stops on the tongue. The first connector element is then connected to a second connector element, with the latch moving into a channel in the second connector. Electrical connections on the first and second connector elements are assured and maintained when the two connector elements are in a position with the latch fully received in the channel. After the electrical connection is made, the interlock plate is moved to the locked position. Abutment members on the interlock plate and the first connector element prevent the latch from being moved outwardly of the channel. Should it be desired to disconnect the electrical connection, the interlock plate is first moved back to the unlocked position. The latch can then be moved outwardly of the channel, and the two connectors disconnected.

These and other features and objects of the present invention can be best understood from the following specification and drawings, of which the following is a brief description.

DETAILED DESCRIPTION OF A PREFERRED EMBODIMENT

Figure 1:
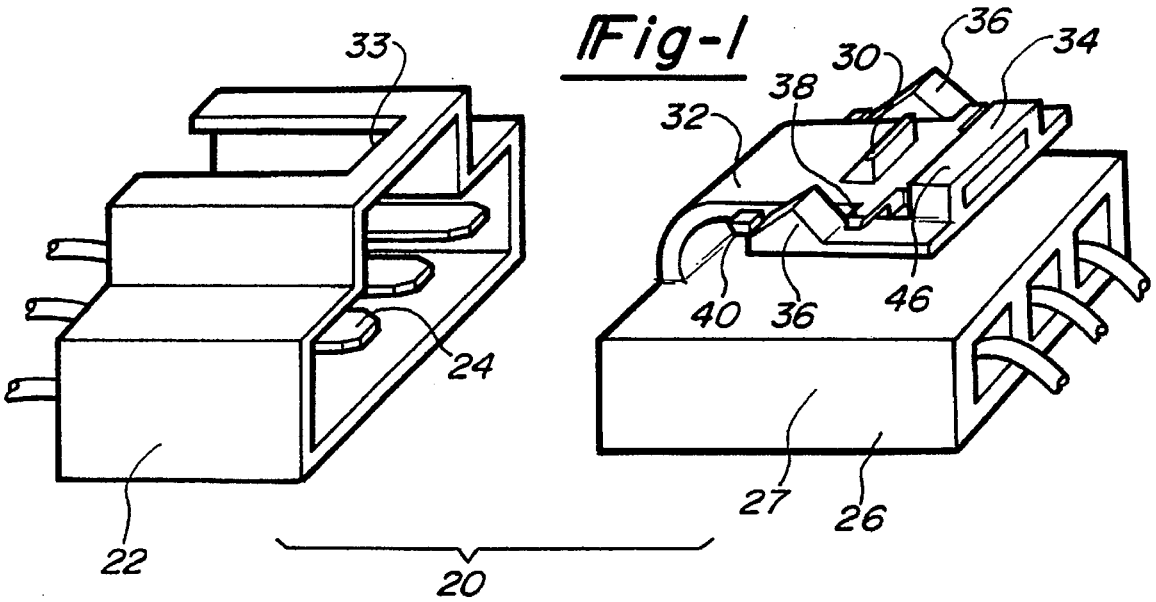
FIG. 1 is an assembly view of an electrical connection according to the present invention.

An electrical connection 20 includes a first connector 22 with electrical connection elements 24 and a second connector 26, having electrical connections which mate with connections 24, as is known. The electrical connector 26 includes a body 27 including a latch 30 formed on a tongue 32. Latch 30 is received within a channel 33 on connector 22 to maintain the connectors 22 and 26 connected. The latch and channel connection is known in the prior art, and experiences problems as described above. To address the problems, an interlock plate 34 is provided, which includes ears 36 received between stop members 38 and 40 to secure interlock plate 34 on tongue 32.

Figure 2:
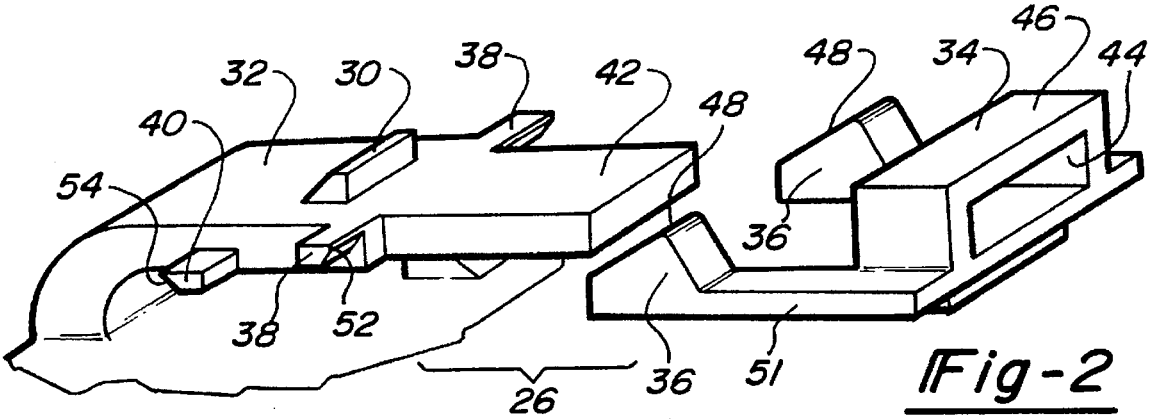
FIG. 2 is a perspective view of a portion of one connector according to the present invention.

As shown in FIG. 2, tongue 32 includes a guide portion 42 forwardly of latch 30, which extends within a guide channel 44 in interlock plate 34. A top surface 46 of interlock plate 34 provides a large push surface for disconnecting latch 30 from channel 33, as will be explained below. Ears 36 include a ramped forward surface 48 and a ramped rear surface 50, which facilitate movement of ears 36 relative to stops 38 and 40. Stops 38 and 40 are formed with respective ramped surfaces 52 and 54, also to facilitate relative movement of ears 36. Ear 36 is connected to the body 49 of interlock plate 34 through an arm 51.

Figure 3:
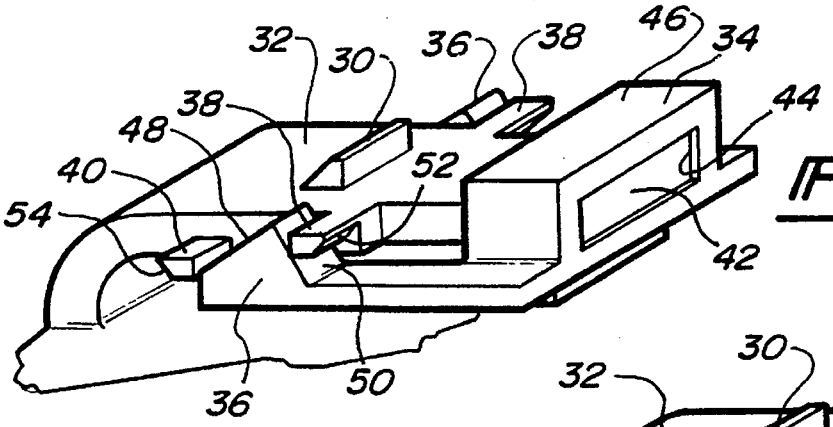
FIG. 3 is a view similar to FIG. 2, but showing a subsequent step in the assembly of the connector.

As shown in FIG. 3, interlock plate 34 is now received on tongue 32 in an unlocked position, as will be described below. To reach this position, ears 36 are biased downwardly, and surface 48 moves along ramp surface 52 to facilitate sliding movement of ear 36 beyond stop 38. Ear 36 is then released, and moves upwardly towards its relaxed position between stop 38 and stop 40. The ear is securely retained between the stops 38 and 40, but with arm 51 in a relaxed position. Thus, interlock plate 34 remains on tongue during shipment of the connector 26.

Figure 4:
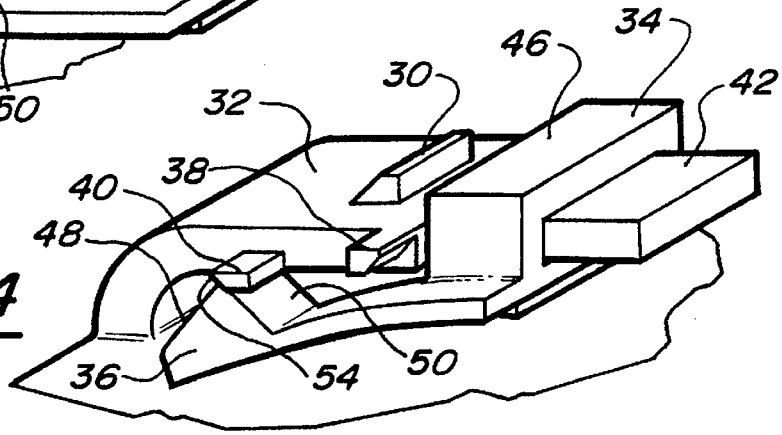
FIG. 4 is a view similar to FIG. 3, but showing yet another subsequent step in the assembly.

As shown in FIG. 4, interlock plate 34 is now being moved towards the locked position. Interlock plate 34 is slid along guide portion 42, with ear 36 biased downwardly to move behind stop 40.

Figure 5:
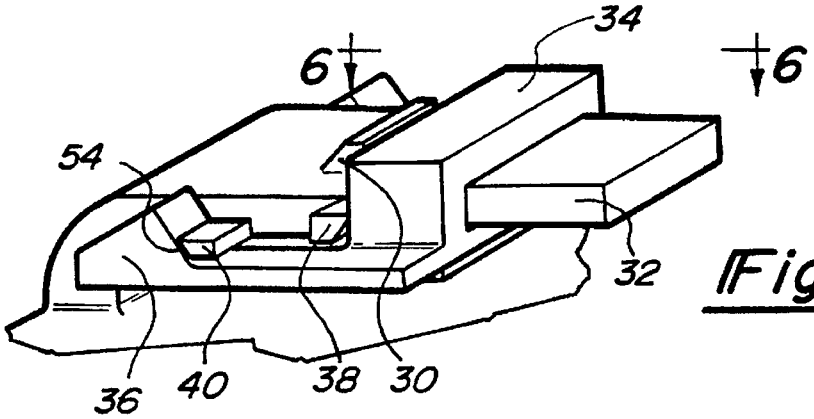
FIG. 5 is a view similar to FIG. 4, but showing yet another subsequent step.

As shown in FIG. 5, ear 36 is now positioned behind stop 40, with ramp surface 50 contacting ramp surface 54. Again, the ear is securely held in this position, but with arm 51 in a relaxed condition. The two ramped surfaces facilitate disconnection and movement of the interlock plate 34 back to an unlocked position, as will be explained below.

Figure 6:
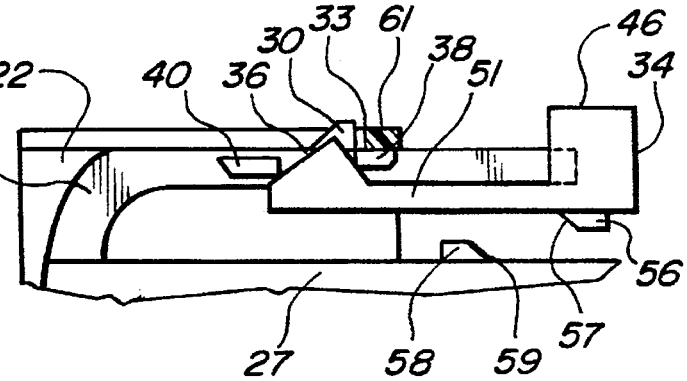
FIG. 6 is a cross-sectional view through the electrical connection shown in FIG. 1, with one of the connectors in the position approximately as shown in FIG. 3.

As shown in FIG. 6, latch 30 is received within channel 33. An electrical connection between the connection element is assured while the latch is maintained in the channel. Interlock plate 34 is in the unlocked position shown in FIG. 3. As shown, an abutment 56 having a ramped surface 57 is formed on an undersurface of interlock plate 34. A second abutment 58 having an opposed ramped surface 59 is formed on body 27. Abutments 56 and 58 are not aligned in this tinlocked position. Should an assembler wish to disconnect latch 30 from channel 33 while interlock plate 34 is in this unlocked position, then latch 30 may be simply moved downwardly by pressing downwardly on any portion of tongue 32. Top surface 46 of interlock plate 34 provides a convenient and comfortable surface for depressing the tongue 32, and consequently latch 30, vertically downwardly as shown in FIG. 6 to allow disconnection of connectors 22 and 26.

Figure 7:
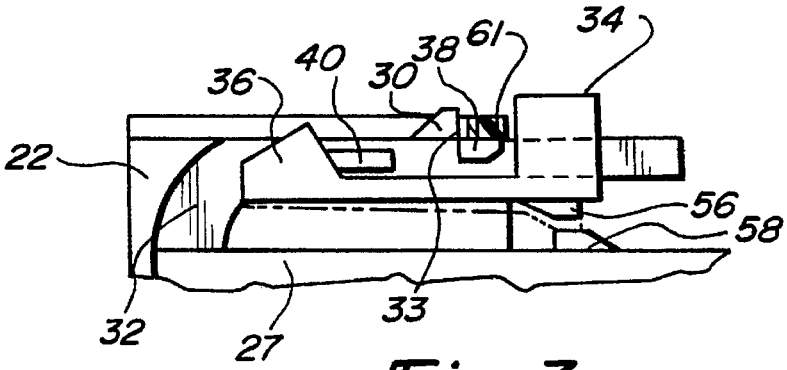
FIG. 7 is a cross-sectional view similar to that shown in FIG. 6, but showing the one connector having moved to the position shown in FIG. 5.

Interlock plate 34 is shown in the locked position in FIG. 7. Abutments 56 and 58 are aligned. In this position, should a force, accidental or otherwise, tend to move latch 30 downwardly out of channel 33, abutment 56 will hit abutment 58. Further downward movement will be prevented. Thus, latch 30 may not move outwardly of channel 33, and the connection between electrical connector members 22 and 26 will remain.

The ramped surfaces 57 and 59 on the respective abutment 56 and 58 insure that the plate 34 may be easily moved between the unlocked and locked positions, even when latch 30 is not fully received in channel 33. One major problem with prior electrical connectors is a so-called "partial" connection. In such a partial connection, while the latch 30 may be partially received in channel 33, it is not fully received in channel 33. Assemblers sometimes have difficulty assuring full or complete connection. With interlock plate 34, movement of the plate 34 between the unlocked position to the locked position will force latch 30 to its fully connected position in channel 33. If the latch 30 is not fully received within channel 33, then tongue 32, and consequently interlock plate 34 will be biased slightly downwardly from the position shown in FIG. 6. In such a position, when the interlock plate 34 is moved to the left in the FIG. 6, the ramp surface 57 of abutment 56 will come into contact with ramp surface 59 of abutment 58. Further leftward movement of the interlock plate 34 will cause the abutment 56, and consequently interlock plate 34, to be guided vertically upwardly. This movement would in turn cause tongue 32, and consequently latch 30, to also be brought upwardly, with latch 30 being moved fully into channel 33. Once interlock plate 34 reaches the fully locked position as shown in FIG. 7, the abutments 56 and 58 have assured that latch 30 is fully received within channel 33.

Another feature of the present invention is that latch 30 cannot move into channel 33 if one attempts to connect electrical connectors 22 and 26 while interlock plate 34 is in the locked position as shown in FIG. 7. In this position, latch 30 cannot be biased downwardly, and thus it cannot move under the portion 59 of connector 22 to be received within channel 33. This feature insures that the interlock plate 34 is in the unlocked position when the electrical connectors 22 and 26 are connected, and that the interlock plate 34 is then moved to the locked position once the latch 30 is received in channel 33.

In a method of assembling an electrical connection according to this invention, interlock plate 34 is initially placed on the guide surface 42 of the tongue 32 of a first connector 26. Interlock plate 34 is positioned at the unlocked position as shown in FIG. 3, where it is retained on the guide surface. The electrical connection is then made by moving latch 30 into the channel 33, and making an electrical connection between the connection members 24 on connector 22 and the mating connections in connector 27. At that time, the connection would resemble the arrangement as shown in FIG. 6. Interlock plate 34 is then moved to the locked position as shown in FIG. 7. In this position, latch 30 cannot move outwardly of channel 33, and the electrical connection will be maintained.

Should it be desired to disconnect the electrical connection between electrical connectors 22 and 26, then ears 33 are initially biased downwardly, with ramp surfaces 50 sliding along ramp surface 54. The interlock plate 34 is then brought to the right as shown in FIG. 7, until ears 36 can move back upwardly between stops 38 and 40. At that time, the members have moved back to the unlocked position as shown in FIG. 6. Latch 30 may then be biased downwardly out of channel 33, and the electrical connection may be disconnected. Top surface 46 is positioned on an opposite side of the portion 61 of connector 22 which forms the front end of channel 33. As described above, top surface 46 facilitates movement of latch 30.

A preferred embodiment of this invention has been disclosed, however, a worker of ordinary skill in the art would recognize that certain modifications would come within the scope of this invention. For that reason, the following claims should be studied to determine the true scope and content of this invention.

We claim:

1. An electrical connection comprising:

a first electrical connector, comprising at least one electrical connection element, and a channel to receive a latch from a second electrical connector;

said second electrical connector having at least one electrical connection element for mating with said at least one electrical connection element of said first electrical connector, said second electrical connector also having a tongue including said latch to be selectively biased into said channel to secure said first and second electrical connectors; and an interlock plate to selectively prevent movement of said latch out of said channel and maintain the connection between said first and second connectors, said plate being selectively moveable over said tongue between locked and unlocked positions, and said plate ensuring said latch is in said channel when moved to said locked position, said plate being secured to one of said first or said second electrical connectors in said unlocked position, and at least one stop secured to one of first and second electrical connectors preventing movement of said plate off of said one of said first or said second electrical connectors when said plate is in said unlocked position, said latch being moveable into said channel when said plate is in said unlocked position; and said plate including a guide channel which is slidable on a guide surface of said tongue, said plate including a top surface positioned outwardly of said guide surface.

2. An electrical connection as recited in claim 1, wherein said plate includes a member which is movable on said second connector, and which is separate from both said first and second connectors.

3. An electrical connection as recited in claim 1, wherein a pair of stops are formed at distinct axial positions along said tongue, and said plate including at least one ear which is selectively positioned between said stops to place said plate in one of said locked and unlocked positions, and beyond both of said stops when said plate is in the other of said locked and unlocked positions said at least one ear providing said stop for retaining said plate on said tongue when said plate is in said unlocked position.

4. An electrical connection as recited in claim 3, wherein said at least one ear is positioned beyond both of said stops when said plate is in said locked position.

5. An electrical connection as recited in claim 3, wherein said stops and said at least one ear have ramped surfaces to facilitate movement of said at least one ear relative to said stops.

6. An electrical connection as recited in claim 5, wherein a forwardmost one of said stops has a ramped surface on a forward facing end, and a rearwardmost of said stops has a ramp surface on a rearwardmost end, said at least one ear having ramp surfaces on both forward and rearward facing surfaces, with said forward facing ramp surface on said at least one ear facilitating movement of said ear along said ramp surface of said forwardmost one of said stops, and said rearward ramp surface of said at least one ear facilitating movement of said at least one ear relative to said rearwardmost of said stops.

7. An electrical connection as recited in claim 3, wherein said plate has a first abutment member which is aligned with a second abutment member on said second connector member when said plate is in said locked position, to prevent said latch from moving outwardly of said channel, with said first abutment members on said plate contacting said second abutment member on said second connector, preventing movement of said latch outwardly of said channel, said first and second abutments not being aligned when said plate is in said unlocked position, such that said latch may move outwardly of said channel.

8. An electrical connection as recited in claim 1, wherein said means to prevent movement is a separate plate having a first abutment member which is aligned with a second abutment member on said second connector when said interlock plate is in said locked position, to prevent said latch from moving outwardly of said channel, with said first abutment member on said interlock plate contacting said abutment member on said second connector, preventing movement of said latch outwardly of said channel, said first and second abutment members not being aligned when said interlock plate is in said unlocked position, such that said latch may move outwardly of said channel.

9. An electrical connection as recited in claim 8, wherein said abutment members having mating ramped surfaces and said abutment ramped surfaces facilitating movement of said plate to said locked position when said latch is not fully received in said channel.

10. An electrical connection as recited in claim 1, wherein said plate includes a top surface being positioned relative to said latch, on an opposed side of a portion of said first connector which forms said channel such that by depressing said top surface of said interlock plate, said tongue, and consequently said latch may move outwardly of said channel to allow disconnection of said first and second connectors.

11. An electrical connector comprising:

an electrical connector body having at least one electrical connection for mating contact with another electrical connector, said electrical connector body carrying a latch which is to be selectively biased into a channel on the other electrical connector; and an interlock plate to selectively prevent movement of said latch out of the channel in the other electrical connector, and maintain a connection between said electrical connector body and the other electrical connector, said plate being selectively moveable relative to said electrical connector body between locked and unlocked positions, and said plate ensuring said latch is in a position such that said latch will be fully received in a channel, when said plate is in said locked position, said plate secured to said electrical connector body when said plate is in said unlocked position, and at leas one stop secured to one of said first and second connectors preventing movement of said plate off of said electrical connector body when said plate is in said unlocked position, said latch being moveable into said channel when said plate is in said unlocked position; and said plate having a first abutment member extending outwardly therefrom which is selectively aligned with a second abutment member extending outwardly of said one electrical connector body when said plate is in said locked position, said first and second abutment members being non-aligned when said plate is in said unlocked position, said first and second abutment members having mating ramp surfaces and said abutment ramp surfaces facilitating movement of said plate to said locked position when said latch is not fully received in said channel.

12. An electrical connector comprising:

a first electrical connector body having at least one electrical connection for mating contact with another electrical connection in a second electrical connector body, said first electrical connector body carrying a tongue including a latch which is to be selectively biased into a channel on said second electrical connector; and an interlock plate to selectively prevent movement of said latch out of the channel in the other connector member, and maintain a connection between said one electrical connector and the other electrical connector, said plate being separate from said first and second electrical connection members and selectively moveable relative to said first electrical connector body between locked and unlocked positions, and said plate ensuring said latch is in a position such that it will be fully received in the channel, when said plate is in said locked position, said plate including a guide channel which is slidable on a guide portion of said latch, said plate including a top surface positioned outwardly of said guide channel, said top surface providing a surface that may be depressed to consequently depress said tongue and move said latch outwardly of the channel which is to receive said latch.

13. An electrical connection comprising:

a first electrical connector, comprising at least one electrical connection element, and a channel to receive a latch from a second electrical connector;

said second electrical connector having at least one electrical connection element for mating with said at leas one electrical connection element of said first electrical connector, said second electrical connector having said latch to be selectively biased into said channel to secure said first and second electrical connectors;

an interlock plate to selectively prevent movement of said latch out of said channel and maintain the connection between said first and second connectors, said plate being selectively moveable between locked and unlocked positions, and said plate being securely retained on said second electrical connector when in said unlocked position;

said plate being slidable along a tongue on said second electrical connector, said tongue also being formed wit said latch, said tongue being formed with a pair of stops at distinct axial positions, and said plate including at least one ear selectively positioned between said stops to place said plate in one of said locked and unlocked positions, and beyond both of said stops when said plate is in the other of said locked and unlocked positions; and said at least one ear is positioned beyond both of said stops when said plate is in said locked position.

14. An electrical connection as recited in claim 13, further including a stop preventing movement of said means to prevent movement off of said second electrical connector when said plate is in said unlocked position.

* * * * *